US012232580B2

(12) United States Patent
Konaka et al.

(10) Patent No.: US 12,232,580 B2
(45) Date of Patent: Feb. 25, 2025

(54) SLIDE FASTENER AND METHOD OF PRODUCING WATERPROOF CHAIN

(71) Applicant: YKK Corporation, Tokyo (JP)

(72) Inventors: Toshimasa Konaka, Kurobe (JP); Takayuki Ogyu, Kurobe (JP); Mamoru Usuda, Kurobe (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 18/221,565

(22) Filed: Jul. 13, 2023

(65) Prior Publication Data

US 2024/0108106 A1 Apr. 4, 2024

(30) Foreign Application Priority Data

Oct. 3, 2022 (JP) ..... 2022-159613

(51) Int. Cl.
*A44B 19/32* (2006.01)
*A44B 19/34* (2006.01)

(52) U.S. Cl.
CPC ..... *A44B 19/32* (2013.01); *A44B 19/343* (2013.01); *A44B 19/346* (2013.01)

(58) Field of Classification Search
CPC ..... A44B 19/32; A44B 19/343; A44B 19/346
See application file for complete search history.

(56) References Cited

U.S. PATENT DOCUMENTS 5,386,616 A * 2/1995 Norvell ..... A44B 19/32 24/384
6,105,214 A 8/2000 Press
6,343,408 B1 * 2/2002 Neugebauer ..... A44B 19/32 24/392
6,427,294 B1 8/2002 Shibaike et al.
8,397,353 B2 * 3/2013 Chou ..... A44B 19/32 24/392
9,700,106 B2 * 7/2017 Kojima ..... A44B 19/346
10,130,149 B1 * 11/2018 Liping ..... A44B 19/346
10,369,765 B2 * 8/2019 Konaka ..... B32B 37/12
10,433,620 B2 * 10/2019 Kameyama ..... B29D 5/02
2004/0237266 A1 * 12/2004 Wang ..... A44B 19/32 24/389
2006/0016051 A1 1/2006 Wang et al.
(Continued)

FOREIGN PATENT DOCUMENTS

JP 3580725 B2 10/2004
JP 4689631 B2 5/2011
JP 5908938 B2 4/2016
(Continued)

*Primary Examiner* — Robert Sandy

(74) *Attorney, Agent, or Firm* — Procopio, Cory, Hargreaves & Savitch LLP

(57) ABSTRACT

Slide fastener includes a pair of waterproof stringers including a pair of woven and/or knitted fastener tapes, a pair of coil elements respectively secured to opposing side-edge portions of the pair of fastener tapes, and waterproof films respectively overlaid via adhesives on tape top surfaces of the fastener tapes of the pair of fastener tapes, and a slider that moves forward to engage the pair of coil elements and moves rearward to disengage the pair of coil elements. The adhesive penetrates into a structure of the fastener tape such that the waterproof film and the fastener tape are in direct contact at least partially.

18 Claims, 7 Drawing Sheets

(56) References Cited

U.S. PATENT DOCUMENTS

| | | | | |
|---|---|---|---|---|
| 2008/0189918 | A1 | 8/2008 | Kusayama | |
| 2010/0125982 | A1* | 5/2010 | Chou | A44B 19/32<br>24/397 |

FOREIGN PATENT DOCUMENTS

| | | | |
|---|---|---|---|
| TW | 200304785 | A | 10/2003 |
| TW | 201406317 | A | 2/2014 |
| WO | 2021/048936 | A1 | 3/2021 |

* cited by examiner

[Figure 1]
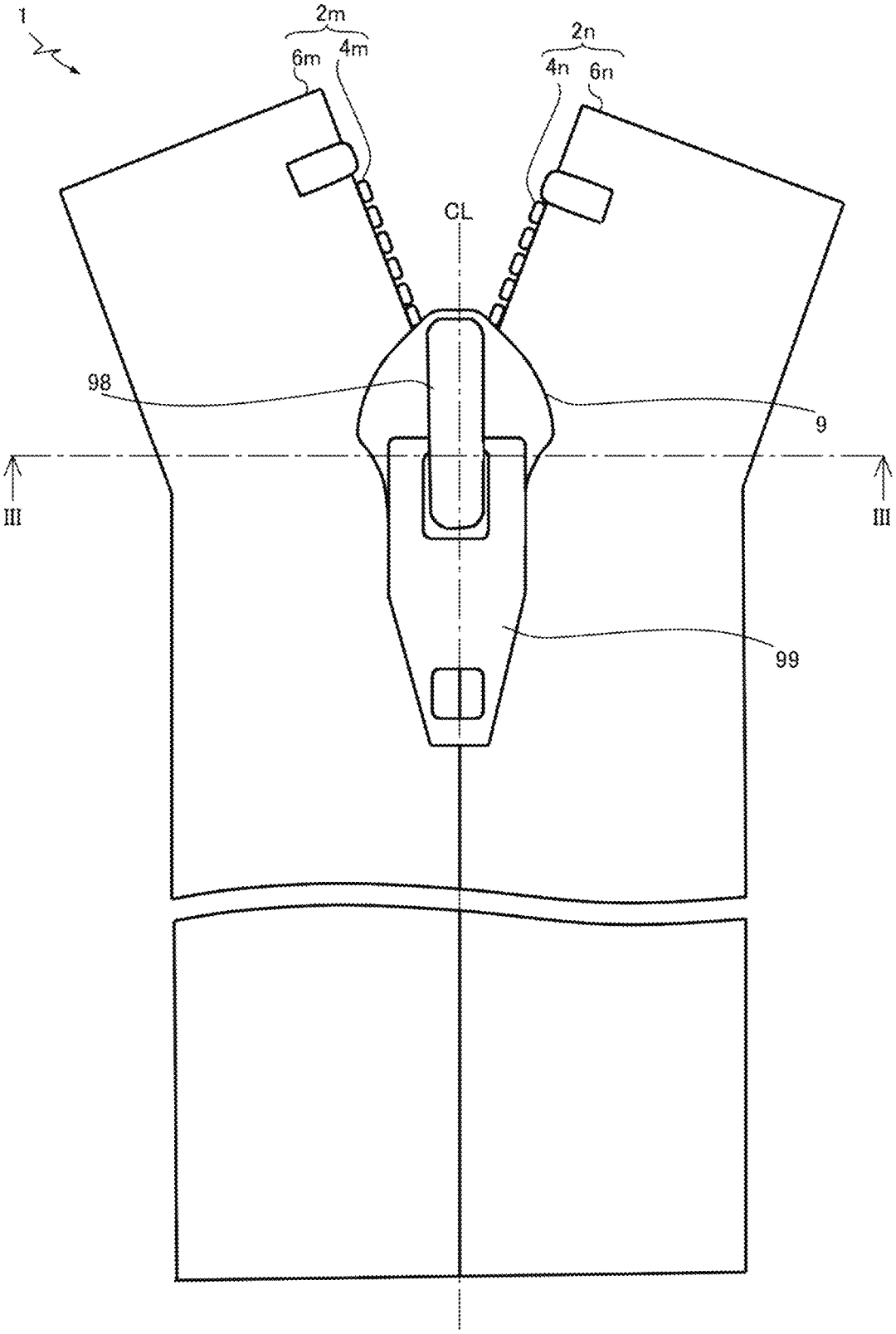

[Figure 2]
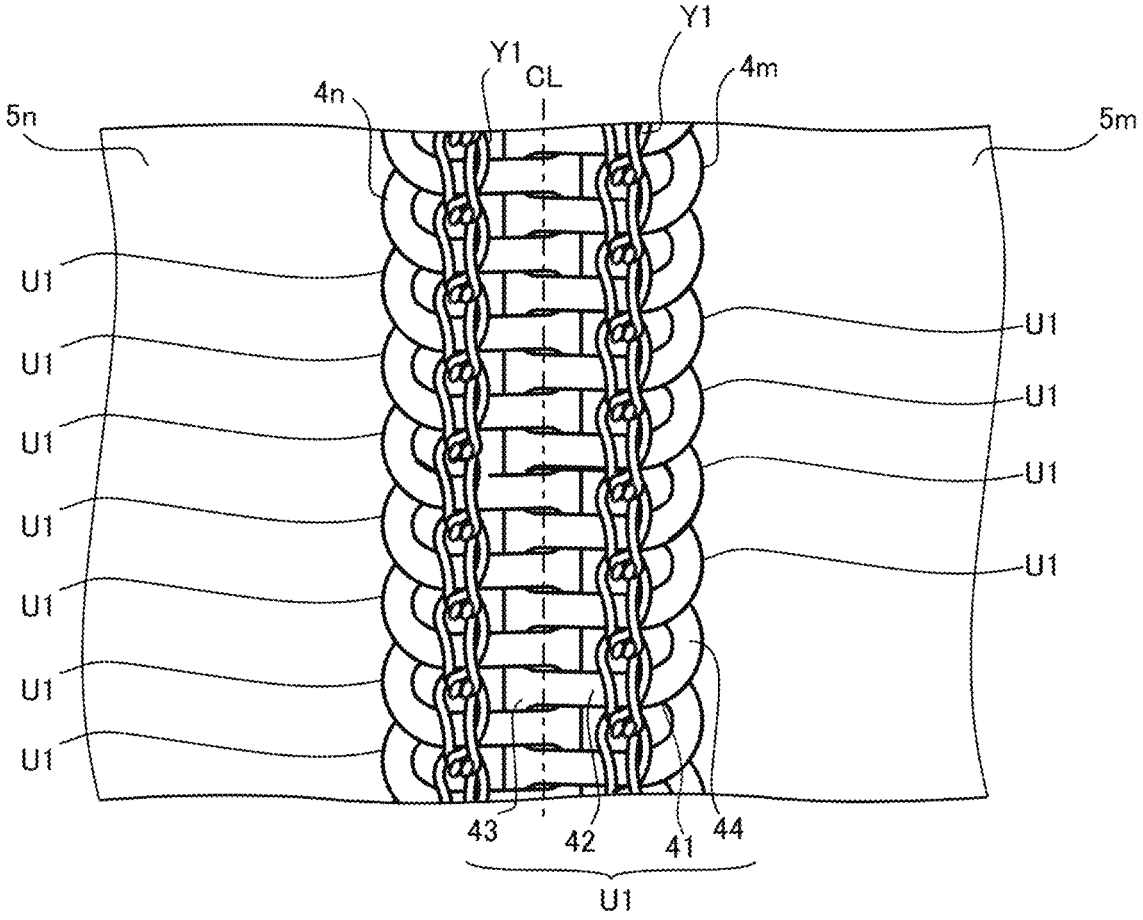

[Figure 3]
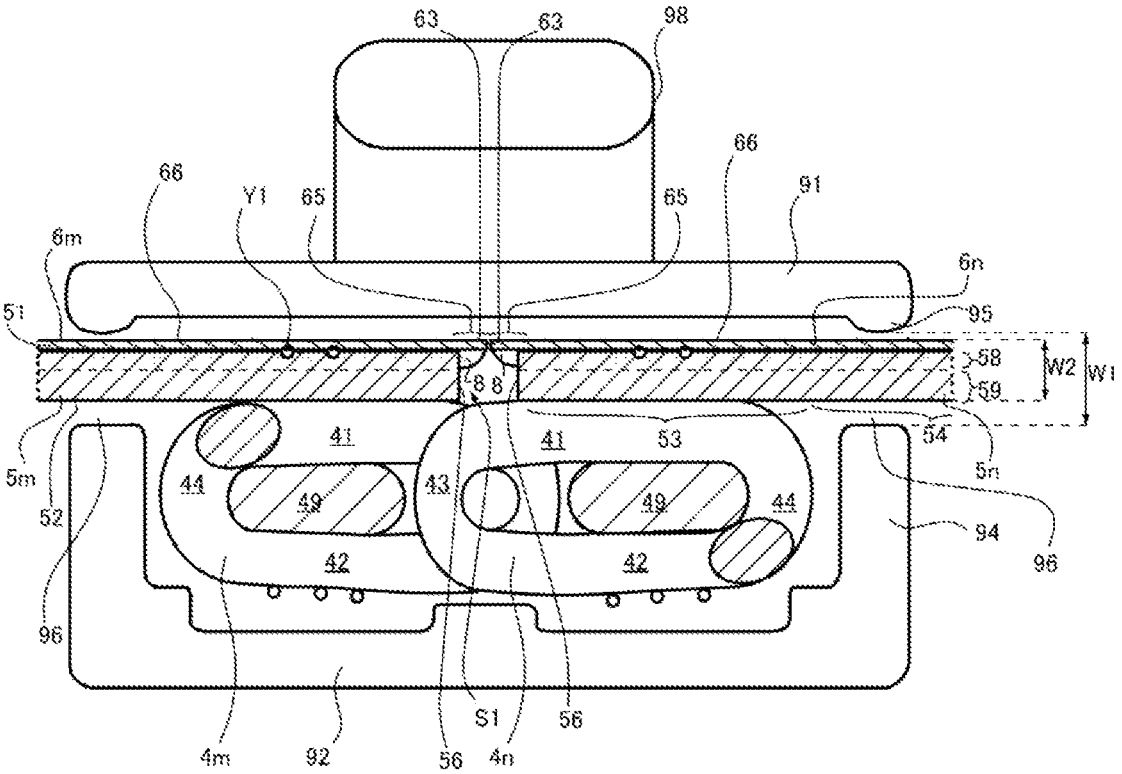

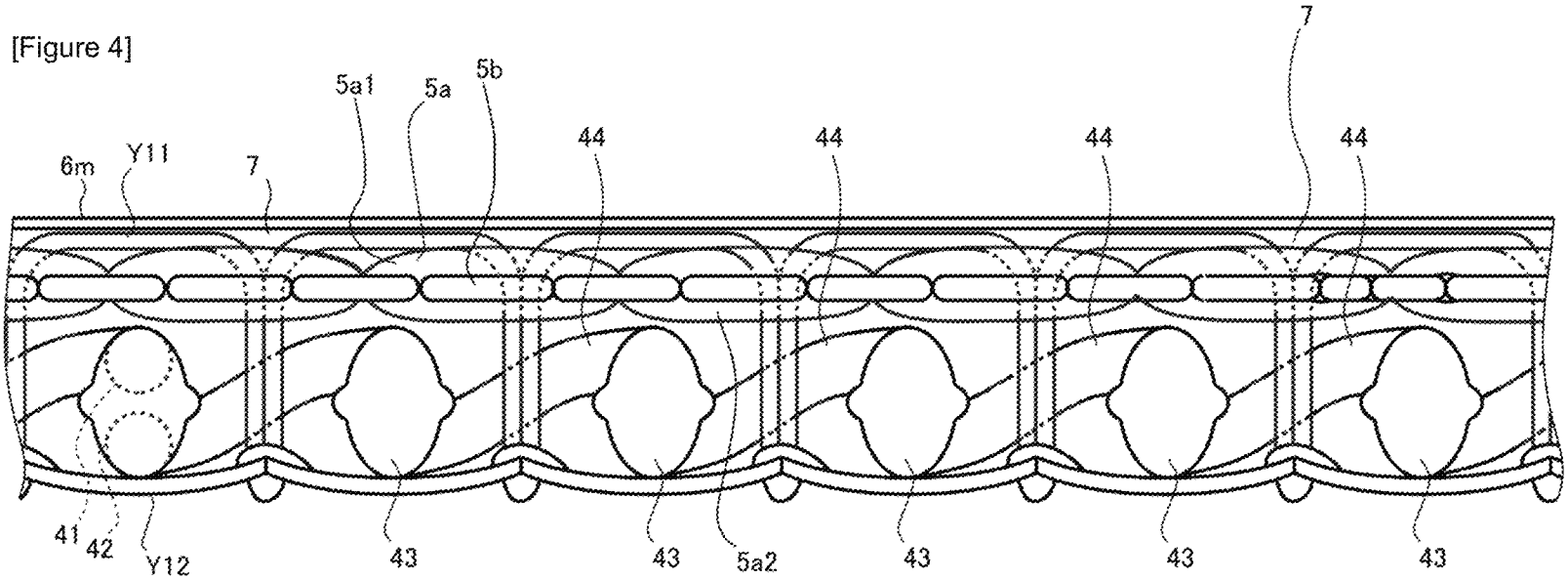
[Figure 4]

[Figure 5]
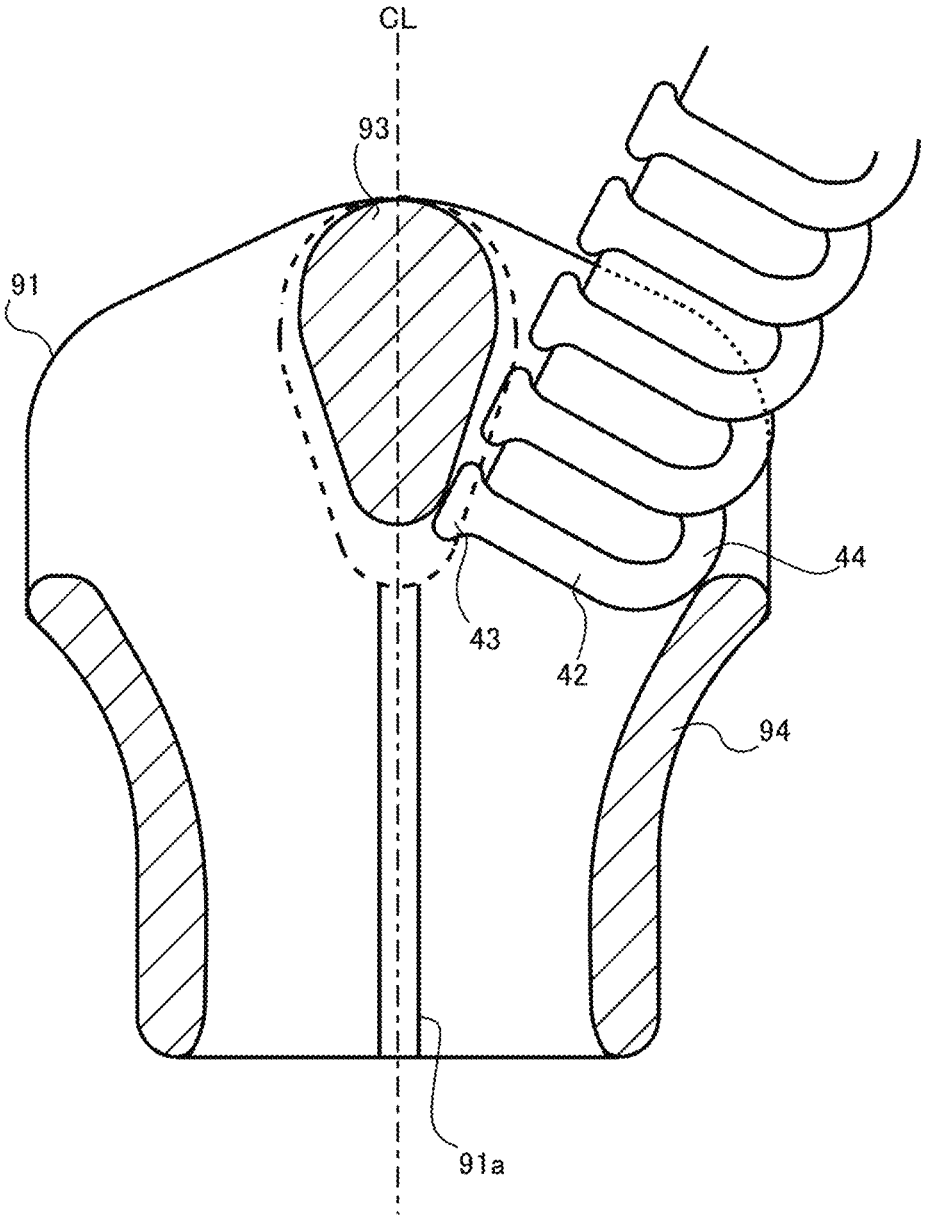

[Figure 6]
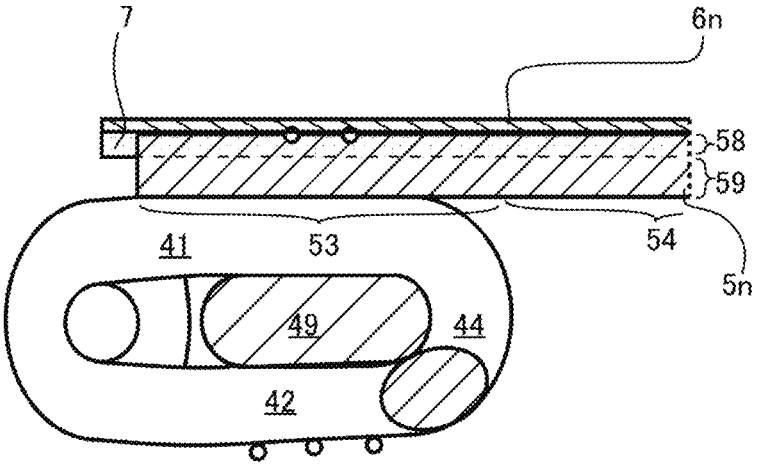
[Figure 7]
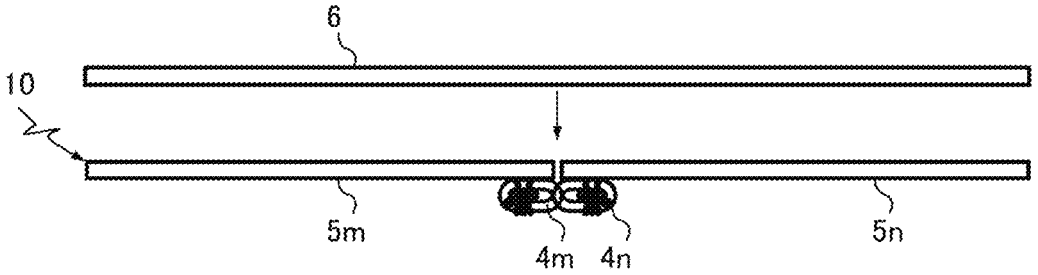
[Figure 8]
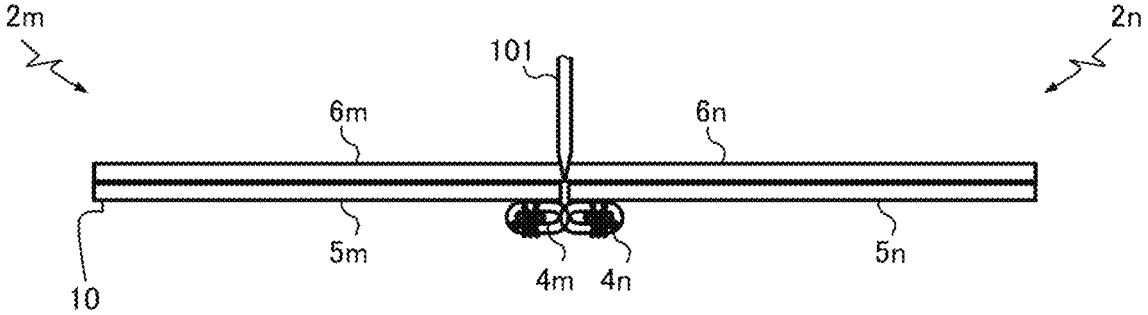

SLIDE FASTENER AND METHOD OF PRODUCING WATERPROOF CHAIN

CROSS-REFERENCE TO RELATED APPLICATIONS

This application claims a benefit of Japanese Patent Application No. 2022-159613 filed in Japan on Oct. 3, 2022, the entire content of which is hereby incorporated by reference.

FIELD OF THE DISCLOSURE

The present disclosure is related to a slide fastener and a method of producing waterproof chain.

BACKGROUND

International Publication No. 2021/048936 discloses a technique to overlay a film to a main portion of a fastener tape via a reactive hot-melt adhesive. The document discloses in its claim 2 that the adhesive layer is formed thicker than the film.

Japanese patent No. 4689631 discloses that a water or oil repellent is applied to a core thread. In this document, a liquid-tight layer such as a polyurethane film or the like is glued or adhered to a surface of fastener chain (See para. 0025 and 0034 thereof).

Japanese patent No. 3580725 discloses that a synthetic resin film consisting of a laminate of a low melting resin layer and a high melting resin layer is overlaid to a fastener tape, and the low melting resin layer adheres to the fastener tape. The document illustrates in its FIG. 7 a state where a side edge of the fastener tape is partially covered by the lamination synthetic resin film. Japanese patent No. 5908938 discloses that a low-temperature melding layer is embedded in material of tape.

SUMMARY

Sliders with common specification are generally employed regardless of whether slide fasteners are waterproof or not. Therefore, in a waterproof slide fastener wherein a waterproof film is overlaid to a fastener tape via adhesive, the thickness would be increased in accordance with total thickness of the waterproof film and the adhesive layer, resulting in increased sliding resistance for the slider. Furthermore, as the fastener tape is a woven or knitted web, it would be not possible to fully present water penetration through the fastener tape even if the waterproof film is overlaid to the fastener tape. Note that, in a case of FIG. 5 of Japanese patent No. 5908938, the thickness would be increased in accordance with total thickness of a thickness of upper portion of inner layer (low temperature melting layer) and a thickness of outer layer. As such, there is a technical challenge to simultaneously achieve further improvement of waterproofness of slide fastener and further reduction of sliding resistance for slider.

Embodiment 1

Slide fastener according to an aspect of the present disclosure may include: a pair of waterproof stringers comprising a pair of woven and/or knitted fastener tapes, a pair of coil elements respectively secured to opposing side-edge portions of the pair of fastener tapes, and waterproof films respectively overlaid via adhesives on tape top surfaces of the fastener tapes of the pair of fastener tapes; and a slider that moves forward to engage the pair of coil elements and moves rearward to disengage the pair of coil elements. The adhesive penetrates into a structure of the fastener tape such that the waterproof film and the fastener tape are in direct contact at least partially.

Embodiment 2

In Embodiment 1, the waterproof film may be transparent to visible light.

Embodiment 3

In Embodiment 1 or 2, a tape top surface of the fastener tape and a bottom surface of the waterproof film may be coplanar.

Embodiment 4

In any one of Embodiments 1 to 3, a penetration depth of the adhesive in the structure of the fastener tape may be equal to or greater than ⅓ or ½ a thickness of the fastener tape.

Embodiment 5

In any one of Embodiments 1 to 4, the penetration depth may be less than ⅔ a thickness of the fastener tape.

Embodiment 6

In any one of Embodiment 1 to 5, the fastener tape may be a woven web woven from a multiplicity of warp threads and at least one weft thread, the multiplicity of warp threads may include one or more warp threads including one or more floating portions, a respective floating portion being in direct contact with the waterproof film.

Embodiment 7

In any one of Embodiment 1 to 6, the fastener tape may be a woven web woven from a multiplicity of warp threads and at least one weft thread, the multiplicity of warp threads may include two or more warp threads including two or more floating portions, a respective floating portion being in direct contact with the waterproof film.

Embodiment 8

In any one of Embodiment 1 to 7, the fastener tape may be a woven web woven from a multiplicity of warp threads and at least one weft thread, every warp thread of the multiplicity of warp threads may include two or more floating portions each in direct contact with the waterproof film.

Embodiment 9

In any one of Embodiment 1 to 8, the slider may include a top wing, a bottom wing, a coupling pillar that interconnects the top wing and the bottom wing, and left and right flanges arranged at least on left and right side-edge portions of the bottom wing, a tape passage defined between the flange and the top wing or between the flange and another flange arranged on the top wing, and wherein $1.82 \geq (W1/W2) \geq 1.4$ may be satisfied where W1 indicates a width or a minimum width of the tape passage in up-down direction, and W2 indicates a thickness or a maximum thickness of a portion of the waterproof stringer which is inserted into the tape passage.

Embodiment 10

In any one of Embodiment 1 to 9, the slider may include a top wing, a bottom wing, a coupling pillar that interconnects the top wing and the bottom wing, and an elongated partition arranged on the top wing and extending rearward from the coupling pillar, and wherein the waterproof film may have a film edge that is in contact with the elongated partition inside the slider.

Embodiment 11

In any one of Embodiment 1 to 10, the pair of fastener tapes each may include an upper portion to which the adhesive penetrates and a lower portion to which a water repellent adheres.

Embodiment 12

In any one of Embodiment 1 to 11, the upper portion may not include a water repellent.

Embodiment 13

Method of producing a waterproof chain according to another aspect of the present disclosure may include: a step of overlaying a common waterproof film via adhesive onto tape top surfaces of both fastener tapes of a pair of fastener tapes of a fastener chain, the fastener chain including a pair of fastener stringers including the pair of fastener tapes which are woven and/or knitted and a pair of coil elements respectively secured to opposing side-edge portions of the pair of fastener tapes;

a step of pressing a laminate of the fastener tape, the adhesive and the fastener tape such that the adhesive penetrates into a structure of the fastener tape to allow the waterproof film and the fastener tape to be in direct contact at least partially;

a step of solidifying the adhesive; and a step of cutting the waterproof film by a cutting tool at a position directly over a space between the opposing side-edge portions of the pair of fastener tapes.

Embodiment 14

The adhesive may be a thermosetting resin, and the step of solidifying the adhesive may be performed between the step of pressing the laminate and the step of cutting the waterproof film.

Embodiment 15

The waterproof film may be transparent to visible light.

Embodiment 16

Further included may be applying water repellent at least to a lower portion of the fastener tape after the adhesive penetrates into an upper portion of the fastener tape.

Embodiment 17

A slide fastener may include: a first waterproof stringer comprising a woven and/or knitted first fastener tape, a first coil element secured to a first side-edge portion of the first fastener tape, and a first waterproof film overlaid via first adhesive on a tape top surface of the first fastener tape; a second waterproof stringer comprising a woven and/or knitted second fastener tape, a second coil element secured to a second side-edge portion of the second fastener tape, and a second waterproof film overlaid via second adhesive on a tape top surface of the second fastener tape, the second side-edge portion opposing to the first side-edge portion; and a slider that moves forward to engage the first and second coil elements and moves rearward to disengage the first and second coil elements, wherein the first adhesive penetrates into a structure of the first fastener tape such that the first waterproof film and the first fastener tape are in direct contact at least partially, and the second adhesive penetrates into a structure of the second fastener tape such that the second waterproof film and the second fastener tape are in direct contact at least partially.

BRIEF DESCRIPTION OF DRAWINGS

FIG. 1 is a schematic top view of slide fastener according to an aspect of the present disclosure.

FIG. 2 is a schematic partial bottom view of slide fastener, illustrating a state where coil elements are engaged.

FIG. 3 is a schematic cross-sectional view taken along a dash line III-Ill in FIG. 1.

FIG. 4 discloses a schematic view illustrating a condition where a coil element is sewn by sewing thread(s) to a ground structure of fastener tape.

FIG. 5 is a schematic view of internal structure of slider with an illustration of coil element introduced into element passage between a coupling pillar and a flange.

FIG. 6 is a schematic view illustrating an embodiment where water repellent adheres to a lower portion of the fastener tape.

FIG. 7 is a schematic process diagram for illustrating a process of production of slide fastener.

FIG. 8 is a schematic process diagram for illustrating a process of production of slide fastener.

DETAILED DESCRIPTION

Figure 9:
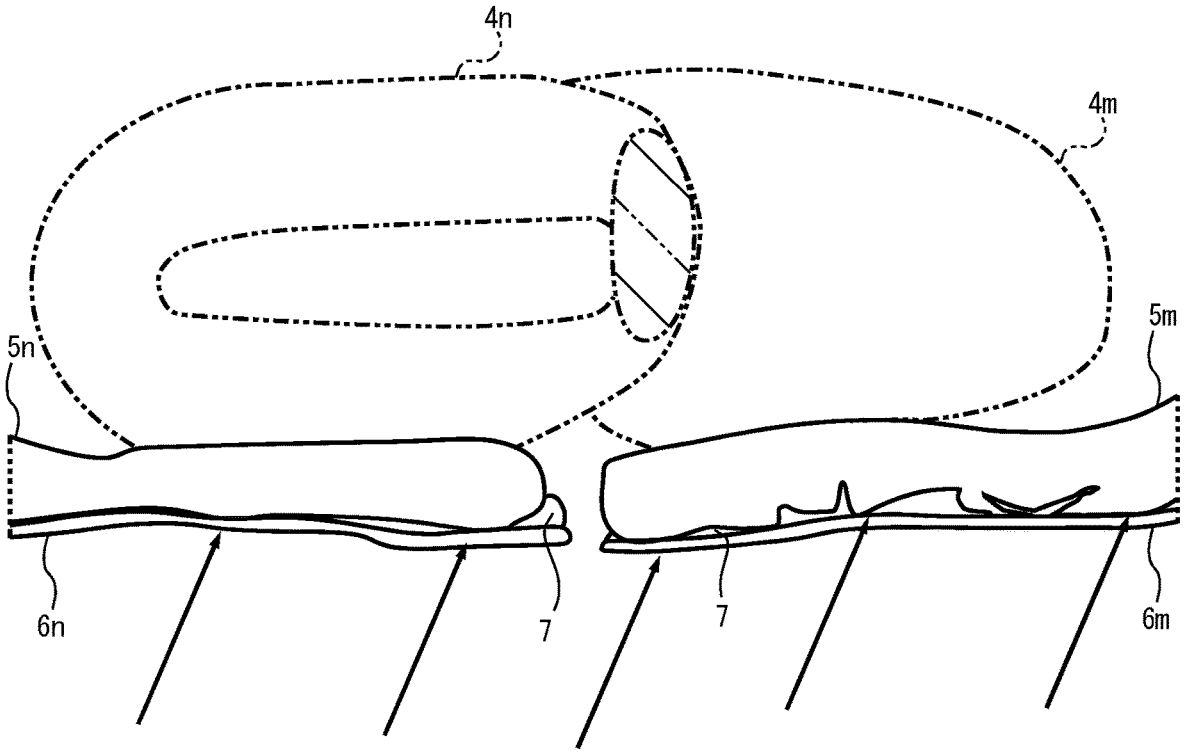
FIG. 9 is a photograph showing a cross-section of sample.

Hereinafter, non-limiting embodiments and features of the present invention would be discussed with reference to drawings. A skilled person would be able to combine respective embodiments and/or respective features without requiring excess description, and would appreciate synergistic effects of such combinations. Overlapping descriptions among the embodiments are basically omitted. Referenced drawings aim mainly for describing inventions and are simplified for the sake of convenience of illustration. The respective features should be appreciated as universal features not only effective to a slide fastener presently disclosed but also effective to other various slide fasteners not disclosed in the present specification.

In the present specification, a direction of movement of slider 9 for opening and closing a slide fastener 1 defines a front-rear direction. A direction parallel to a width direction of slide fastener 1 defines a left-right direction. A direction parallel to a thickness direction of slide fastener 1 defines an up-down direction. Note that the up-down direction is orthogonal to both of the front-rear direction and the left-right direction. The up-down direction does not necessarily indicate a vertical direction (a direction of gravity). For example, when the slide fastener 1 is oriented such that its elongation direction is aligned to a vertical direction, the up-down direction with respect to the slide fastener 1 would be in a horizontal direction (which is orthogonal to the vertical direction). As such, the directions in the present specification is irrelevant to the vertical direction. Note that, directions other than the front-rear direction, left-right direction, and up-down direction may be occasionally referred as described below.

Description follows with reference to FIGS. 1 to 5. Slide fastener 1 is a flexible elongated part extending longer in the front-rear direction with a constant width in the left-right direction, and has a pair of waterproof stringers (first and second waterproof stringers) 2*m*,2*n* and at least one slider 9. Each of the waterproof stringers 2*m*,2*n* has a coil element 4*m*,4*n*, a fastener tape 5*m*,5*n*, and a waterproof film 6*m*,6*n*. The waterproof film 6*m*,6*n* is overlaid to the fastener tape 5*m*,5*n* via adhesive 7. The coil elements 4*m* and 4*n* may be referred to as first and second coil elements. The same applies to the fastener tapes 5*m* and 5*n*, and the waterproof film 6*m* and 6*n*. The adhesive 7 for the first fastener tape and the first waterproof film may be referred to as first adhesive. The adhesive 7 for the second fastener tape and the second waterproof film may be referred to as second adhesive. As the slider 9 moves forward, the pair of coil elements 4*m*,4*n* are engaged (simultaneously the waterproof stringers 2*m*,2*n* are closed) and as the slider 9 moves rearward, the pair of coil elements 4*m*,4*n* are disengaged (simultaneously the waterproof stringers 2*m*,2*n* are open). Note that the fastener tapes 5*m*,5*n* are flat in the illustrated example but a fold may be formed nearby the center line CL to configure a so-called "conceal" slide fastener.

The pair of coil elements 4*m*,4*n* are attached, typically sewn by double chain stitch, to the opposing side-edge portions 53 of the first and second fastener tapes 5*m*,5*n*. These side-edge portions 53 may be referred to as first and second side-edge portions. Each coil element 4*m*,4*n* is made of a monofilament helically wound and includes a series of units U1 each consisting of a top leg 41, bottom leg 42, engagement head 43 and return portion 44 (See FIGS. 2-4). The engagement head 43 has a biting portion formed to be wider in the front-rear direction through plastic deformation of monofilament, allowing engagement between the left and right coil elements 4*m* and 4*n*. Core thread 49 may be inserted in the inside of the coil element 4*m*,4*n* to increase mechanical strength of the coil element 4*m*,4*n* or attachment strength to the fastener tape 5*m*,5*n* by sewing thread(s) Y1. In cases of double chain stitch, the sewing threads Y1 may include at least one needle thread Y11 and at least one looper thread Y12 (See FIG. 4).

The top leg 41 and the bottom leg 42 each extends in the width direction of the fastener tape 5*m*,5*n* and has a tape-outward end and a tape-inward end. The engagement head 43 extends in the up-down direction so as to interconnect the tape-outward end of the top leg 41 and the tape-outward end of the bottom leg 42. The return portion 44 extends to curve so as to interconnect the tape-inward end of the bottom leg 42 and the tape-inward end of the top leg 41 between adjacent units U1. Tape-outward indicates, regarding one fastener tape, a direction directed from a point on the tape surface of the fastener tape to a point outside of the tape surface of the fastener tape so as to cross (e.g. be orthogonal to) the opposing side-edge portion 53. Tape-inward indicates, regarding one fastener tape, a direction directed from a point outside of the tape surface of the fastener tape to a point on the tape surface of the fastener tape so as to cross (e.g. be orthogonal to) the opposing side-edge portion 53.

The slider 9 has a top wing 91, bottom wing 92 and coupling pillar 93 that couples these wings 91 and 92, not necessarily limited to this though. The coupling pillar 93 extends in the up-down direction between front end portions of the top and bottom wings 91 and 92 to interconnect them, thereby forming a Y-shaped element passage (See FIG. 5). Two front mouths are arranged at the both left and right sides of the coupling pillar 93 and one rear mouth is arranged opposite to these front mouths. Partition 91*a* elongated rearward from the coupling pillar 93 (See FIG. 5) can be provided in the top wing 91. The coil element 4*m*,4*n* (particularly the engagement head 43) may be brought into contact with the coupling pillar 93 of the slider 9. In cases where the elongated partition 91*a* is arranged, the film edge 65 and/or the supporting portion 8 described below may be in contact with the elongated partition 91*a* in the slider 9, possibly enhancing watertightness in the slider 9. Furthermore, the film edge 65 may withstand the contact with the elongated partition 91*a* as being reinforced by the supporting portion 8. Note that, the elongated partition 91*a* can be omitted as illustrated in FIG. 3.

Flanges 94 and 95 may be arranged in order to define the passage for the coil elements 4*m* and 4*n* in the width direction of the slide fastener 1. There are provided flanges 94 extending in the front-rear direction (and protruding upward) on left and right side-edges of the bottom wing 92. Also, there are provided flanges 95 extending in the front-rear direction (and protruding downward) on left and right side-edges of the top wing 91. The flanges 94 and 95 are arranged to face one another in the up-down direction, thereby forming a tape passage 96 through which the fastener tape 5*m*,5*n* is allowed to pass. Note that one of the flanges 94 and 95 may be omitted. Preferably, the height of the flange 94 is increased which is at a side where the coil element 4*m* and 4*n* is arranged relative to the fastener tape 5*m* and 5*n*, and the height of the flange 95 at the opposite side is decreased.

Now we return to FIG. 3 for further discussion. The fastener tape 5*m*,5*n* has a tape top surface 51 and a tape bottom surface 52 which define a thickness of the tape. The waterproof film 6*m*,6*n* is overlaid to the tape top surface 51 via adhesive 7. The coil element 4*m*,4*n* is arranged on the tape bottom surface 52. Furthermore, the fastener tape 5*m*,5*n* can be sectioned, in its width direction (left-right direction), into a side-edge portion 53 to which the coil element 4*m*,4*n* is attached and a tape main portion 54 of a remainder other than the side-edge portion 53, and the side-edge portion 53 may be narrower in width than the tape main portion 54.

The fastener tape 5*m*,5*n* is colored by at least one color (e.g. red, blue, green, yellow and the like). Coloring of the fastener tape 5*m*,5*n* may be achieved by weaving or knitting a fastener tape 5*m*,5*n* using undyed ground threads and then supplying this fastener tape 5*m*,5*n* to a dyeing tank (e.g. a fastener chain is transferred in a manner of roll-to-roll and passed through the dyeing liquid), or by weaving or knitting a fastener tape 5*m*,5*n* using ground threads dyed in advance. Means such as ink-jet printer may be used to color a top surface of fastener tape 5*m*,5*n* through application of ink layer having a given color or through printing of a pattern having one or more colors.

The waterproof film 6*m*,6*n* may be a resin film (preferably a film made of thermosetting resin) which is liquid-impermeable such as water-impermeable. Advantageously, the waterproof film 6*m*,6*n* may be a polyurethane film, preferably with sufficient flexibility and mechanical strength. The waterproof film 6*m*,6*n* may be precoated on a release paper, for example. In some cases, the top surface of the waterproof film 6*m*,6*n* has a higher degree of smoothness compared with its bottom surface. In another case, the top surface of the waterproof film 6*m*,6*n* is a non-smooth surface that is embossed (its bottom surface may be a smooth surface or non-smooth surface). The waterproof film 6*m*,6*n* may be a transparent film which is preferably transparent to visible light. The waterproof film 6*m*,6*n* has a side surface 63 that extends along the center line CL of the slide fastener 1. The side surfaces 63 at the both left and right sides of the center line CL may face one another with a slight space therebetween or may partially touch one another (e.g. may touch locally in the up-down direction and/or the front-rear direction). The thickness of the waterproof film 6*m*,6*n* is preferably in a range between 20 μm and 100 μm, and more preferably in a range between 20 μm and 70 μm. The side surface 63 is a surface formed by cutting the waterproof film 6.

The waterproof film 6*m*,6*n* has a film edge 65 protruding toward the center line CL of the slide fastener 1 (away from the opposing side surface 56 of the fastener tape 5*m*,5*n*), and a film main portion 66 of a remainder other than the film edge 65. The film edges 65 of the first and second waterproof films 6*m* and 6*n* may be referred to as first and second film edges. Directly under the film edge 65, the fastener tape 5*m*,5*n* is not provided and a space S1 between the fastener tapes 5*m* and 5*n* is provided. Directly under the film main portion 66, the fastener tape 5*m*,5*n* is provided. Preferably, the waterproof film 6*m*,6*n* covers the entire area of the tape top surface 51 of the fastener tape 5*m*,5*n*.

The adhesive 7 may be thermoplastic or thermosetting adhesive. More preferably, the adhesive 7 is thermosetting, and is solidified as heat-initiated cross-linking reaction progresses and maintains its shape after the solidification (i.e. would not soften even at higher temperature again). The adhesive 7 is polyurethane resin, phenolic resin or epoxy resin, for example. In the present embodiment, the adhesive 7 penetrates into a structure of the fastener tape 5*m*,5*n* such that the waterproof film 6*m*,6*n* and the fastener tape 5*m*,5*n* are in direct contact at least partially. The first adhesive 7 penetrates into a structure of the first fastener tape 5*m* such that the first waterproof film 6*m* and the first fastener tape 5*m* are in direct contact at least partially, and the second adhesive 7 penetrates into a structure of the second fastener tape 5*n* such that the second waterproof film 6*n* and the second fastener tape 5*n* are in direct contact at least partially. This allows further reduction of thickness of adhesive layer formed between the fastener tape 5*m*,5*n* and the waterproof film 6*m*,6*n* and simultaneously, further suppression of liquid from penetrating into the structure of the fastener tape 5*m*,5*n*. There is no adhesive 7 where a part of the fastener tape 5*m*,5*n* is in direct contact with the waterproof film 6*m*,6*n*, possibly inviting reduction of peel strength of the waterproof film 6*m*,6*n* but this is in allowable extent according to our verification. Optionally, the waterproof film 6*m*,6*n* and the adhesive 7 may be of same material or of material of same type (preferably both are made of polyurethane resin), preventing the waterproof film 6*m*,6*n* and the adhesive 7 from easily peeling off one another. In cases where the waterproof film 6*m*,6*n* is a transparent film, a transparent adhesive (e.g. containing no inorganic or organic pigment) may preferably be used for the adhesive 7, allowing better emergence of the color of fastener tape 5*m*,5*n*.

In cases where a transparent film is used for the waterproof film 6*m*,6*n*, emergence of the color of fastener tape 5*m*,5*n* can be ensured due to direct contact between the waterproof film 6*m*,6*n* and at least a part of the fastener tape 5*m*,5*n* without the adhesive 7 interposed or with a small amount of the adhesive 7 interposed. It may be possible to suppress change in appearance of color of the fastener tape 5*m*,5*n* due to reduction of transmittance of visible light through the adhesive 7, absorption of visible light by the adhesive 7 and/or reflection of visible light rays at an interface between the adhesive 7 and the waterproof film 6*m*,6*n* (e.g. blur in color of the fastener tape 5*m*,5*n* is suppressed). Note that the transparency of the waterproof film 6*m*,6*n* solely indicates that the waterproof film 6*m*,6*n* is transparent to visible light. For example, the transparent film has a transmittance equal to greater than 70% or 80% or 90% for light in a visible range (from 360 nm to 830 nm).

There are cases where a variation in color of fastener tape 5*m*,5*n* observed through the (transparent) waterproof film 6*m*,6*n* is effected due to fluctuation in conditions of manufacturing of slide fastener (such as in temperature, humidity, duration, pressure, speed or the like). Moreover, there are cases where a variation in color of fastener tape 5*m*,5*n* observed through waterproof film 6*m*,6*n* is effected among respective production lines for slide fastener 1. Owing to at least partial direct contact of the fastener tape 5*m*,5*n* with the waterproof film 6*m*,6*n*, it would be possible to suppress a variation in color of fastener tape 5*m*,5*n* observed through waterproof film 6*m*,6*n* due to fluctuation in condition of manufacturing of slide fastener 1 or difference in production line. The slide fastener 1 with the same color would be more easily obtainable regardless of fluctuation in manufacturing condition of slide fastener 1 or difference in production line, thus greatly reducing a burden of production management of slide fastener 1.

Transparent film used as the waterproof film 6*m*,6*n* may not necessarily be one in which one or both of top and bottom surfaces are smooth but one in which one or both of top and bottom surfaces are embossed and not smooth (e.g. a group of protrusions or recesses is formed two-dimensionally). The emboss causes diffused reflection of light and allows a matte effect. Note that the use of transparent film with smooth top and bottom surfaces allows a shining effect. In either types of transparent film is used, the color of the fastener tape 5*m*,5*n* would be more faithfully emerged due to the at least partial direct contact between the fastener tape 5*m*,5*n* and the waterproof film 6*m*,6*n*. Typically, the tape top surface 51 of the fastener tape 5*m*,5*n* and the bottom surface of the waterproof film 6*m*,6*n* are coplanar. Surface unevenness of the tape top surface 51 of the fastener tape 5*m*,5*n* (e.g. surface unevenness in accordance with floating and sinking of warp thread or surface unevenness in accordance with circular cross-sectional shape of threads) may be smoothened by penetration of the adhesive 7 into the structure of the fastener tape 5*m*,5*n*. As a result of this, the surface unevenness of the tape top surface 51 of the fastener tape 5*m*,5*n* would be less likely viewable via the waterproof film 6*m*,6*n* or the degree would be lesser.

The direct contact between the waterproof film 6*m*,6*n* and the fastener tape 5*m*,5*n* may cover an entire area of the tape top surface 51 of the fastener tape 5*m*,5*n*. In cases where the fastener tape 5*m*,5*n* is a woven web woven from a multiplicity of warp threads 5*a* and at least one weft thread 5*b* (See FIG. 4), the above-described direct contact may correspond to two-dimensional interspersed arrangement of local contacts of floating portion 5*a*1 of the warp thread 5*a* with the bottom surface of the waterproof film 6*m*,6*n*. For example, the weft thread 5*b* and the waterproof film 6*m*,6*n* are not in direct contact, allowing the adhesive 7 to be interposed between them. Furthermore, there is no need for every warp thread 5*a* to touch the waterproof film 6*m*,6*n* at every floating portion 5*a*1 thereof.

The penetration of the adhesive 7 into the structure of the fastener tape 5*m*,5*n* may cover an entire area of the tape top surface 51 of the fastener tape 5*m*,5*n*. The penetration of the adhesive 7 into the structure of the fastener tape 5*m*,5*n* may be caused continuously two-dimensionally in a plane in which the fastener tape 5*m*,5*n* exists. As a result of this, the upper portion 58 of the fastener tape 5*m*,5*n* would be a composite layer of the structure thereof (warp threads and the weft thread) and the adhesive 7. The adhesive 7 does not penetrate into the lower portion 59 of the fastener tape 5*m*,5*n*. Boundary between the upper portion 58 and the lower portion 59 can be determined based on existence of the adhesive 7. The upper portion 58 may be referred to as an upper layer and the lower portion 59 may be referred to as a lower layer.

Preferably, a penetration depth of the adhesive 7 in the structure of the fastener tape 5*m*,5*n* is equal to or greater than ⅓ or ½ a thickness of the fastener tape 5*m*,5*n*. In order to maintain a softness of the fastener tape 5*m*,5*n*, the penetration depth is preferably equal to or less than ⅔ a thickness of the fastener tape 5*m*,5*n*. The thickness of the fastener tape 5*m*,5*n* is typically in a range between 300 μm and 600 μm.

In some cases, an adhesive sheet is overlaid to the bottom surface of the waterproof film 6*m*,6*n* in advance, or the adhesive is precoated as an adhesive layer thereon, and a laminate including at least the waterproof film 6*m*,6*n* and the adhesive sheet or layer is overlaid to the fastener tapes 5*m* and 5*n* and then the resultant laminate is pressed in thickness direction. As a result of this, the adhesive sheet penetrates into and is integrated with the structure of the fastener tape 5*m*,5*n*, and the waterproof film 6*m*,6*n* and the fastener tape 5*m*,5*n* are brought into direct contact at least partially. The adhesive 7 may be applied onto the bottom surface of the waterproof film 6*m*,6*n* and then attached to the fastener tape 5*m*,5*n* without using the adhesive sheet. The penetration of adhesive 7 into the structure of the fastener tapes 5*m* and 5*n* would be ensured by appropriately adjusting the viscosity of adhesive 7 and/or by appropriately pressing in up-down direction, allowing the direct contact between the waterproof film 6*m*,6*n* and the fastener tape 5*m*,5*n* at least partially.

The waterproof film 6*m*,6*n* have the film edges 65 arranged over a space S1 between the opposing side-edge portions 53 of the pair of fastener tapes 5*m*,5*n*. This film edge 65 is supported by a supporting portion 8 made of adhesive 7 that is solidified. This supporting portion 8 is formed to partially cover the opposing side surface 56 of the fastener tape 5*m*,5*n*. The supporting portion 8 may have a thickness equal to or less than a thickness of the upper portion 58 of the fastener tape 5*m*,5*n* into which the adhesive 7 penetrated as described above. Typically, the supporting portion 8 has a thickness that gradually reduces toward the central line CL of the slide fastener 1. As a result of this, a sloped surface may be formed in the bottom surface that slants gradually upward toward the center line CL.

The thickness of the waterproof stringer 2*m*,2*n* may be reduced as the adhesive 7 penetrates into the structure of the fastener tape 5*m*,5*n*, and the following condition may be satisfied. In particular, as illustrated in FIG. 3, $1.82 \geq (W1/W2) \geq 1.4$ may be satisfied where W1 indicates a width or a minimum width of the tape passage 96 in up-down direction, and W2 indicates a thickness or a maximum thickness of a portion of the waterproof stringer 2*m*,2*n* which is inserted into the tape passage 96. This may reduce interval or degree of contact between the slider 9 (in particular the flange 94, 95 thereof) and the waterproof stringer 2*m*,2*n*, thereby reducing a sliding resistance for the slider 9. Typically, W1 is in a range between 600 μm and 950 μm. Typically, W2 is in a range between 320 μm and 650 μm.

As a distance in up-down direction between the waterproof stringer 2*m*,2*n* and the flange 94,95 increases, a possibility of liquid flowing into the slider 9 through the interspace increases. In some cases, the film edge 65 of the waterproof film 6*m*,6*n* and/or the supporting portion 8 described above can be in contact with the elongated partition 91*a* and/or the coupling pillar 93 in the slider 9. This suppresses reduction of waterproofness of the slide fastener 1 inside the slider 9. Note that, the coupling pillar 93 may be dimensioned to be thicker in the vicinity of interconnection with the top wing 91 as outlined by dotted line in FIG. 5.

Now referring to FIG. 6 for further discussion. As illustrated in FIG. 6, the adhesive 7 penetrates into and solidifies in the upper portion 58 of the fastener tape 5*m*,5*n*, making it impossible or harder for liquid to penetrate into the upper portion 58. Water repellent may adhere to the lower portion 59 of the fastener tape 5*m*,5*n* in order to prevent penetration of liquid through the fastener tape 5*m*,5*n* (e.g. formation of channel of liquid that penetrates through the structure of the fastener tape 5*m*,5*n* from the space S1 to the tape bottom surface 52 of the fastener tape 5*m*,5*n*). The water repellent may adhere not necessarily to the entire area of the lower portion 59 of the fastener tape 5*m*,5*n* but only to the opposing side-edge portion 53 of the fastener tape 5*m*,5*n*. Boundary between the upper portion 58 and the lower portion 59 of the fastener tape 5*m*,5*n* can be determined based on existence of the adhesive 7 (the illustrated linear boundary is drawn just for convenience of illustration). Various ways such as spray coating and immersion of the waterproof stringer 2*m*,2*n* into water repellent liquid can be adopted for a purpose of application of water repellent.

The water repellent may be applied after the waterproof film 6*m*,6*n* is overlaid to the fastener tape 5*m*,5*n* via the adhesive 7, allowing reduction of amount of water repellent used and allowing the water repellent to adhere to the core thread 49 and the coil element 4*m*,4*n* either, not necessarily limited to this process though. It would be possible to immerse the fastener tape 5*m*,5*n* in water repellent liquid beforehand and then overlay the waterproof film 6*m*,6*n* thereto. In this case, additionally to the structure of the fastener tape 5*m*,5*n* and the adhesive 7, the water repellent would exist in the upper portion 58 of the fastener tape 5*m*,5*n*. By way of precaution, application of water repellent can be omitted.

Operation of the slide fastener 1 would be discussed. As the slider 9 moves forward to engage the left and right coil elements 4*m* and 4*n*, the left and right fastener tapes 5*m* and 5*n* are not in contact due to a space S1 interposed. However, the film edges 65 of the waterproof films 6*m* and 6*n* are arranged directly over this space S2, preventing or suppressing fluid from entering into the space S1. Furthermore, the above-described supporting portion 8 adheres to the film edge 65. Therefore, inflow of liquid via a space between the film edges 65 would be further suppressed.

It is not a requisite for the film edges 65 at both left and right sides of the center line CL of the slide fastener 1 to be brought into contact but, they are expected to be in local or intermittent contact along the center line CL in the elongation direction of the slide fastener 1. The same holds true to the contact between the supporting portions 8 at both left and right sides of the center line CL of the slide fastener 1. Due to cutting by a cutter, the waterproof film 6*m*,6*n* may be partially scraped and the supporting portion 8 may also be partially scraped but, local or intermittent contact may still be caused.

Method of production of slide fastener 1 would be discussed. Firstly, a common waterproof film 6 is overlaid, via adhesive 7, to the tape top surfaces 51 of both of the fastener tapes 5*m*,5*n* of the fastener chain 10 (See FIG. 7). Next, the waterproof film 6 is cut by a cutting tool 101 such as a cutter along the center line CL of the fastener chain 10 at a position directly over the space S1 between the opposing side-edge portions 53 of the fastener tapes 5*m*,5*n* (See FIG. 8). As such, a waterproof chain is obtained in which the waterproof films 6*m* and 6*n* are respectively overlaid to the fastener tapes 5*m* and 5*n*. After or simultaneously with the common waterproof film 6 is overlaid to the tape top surfaces of both of the fastener tapes 5*m*,5*n*, a laminate of the fastener tape 5*m*,5*n*, the adhesive 7 and the fastener tape 5*m*,5*n* can be pressed such that the adhesive 7 penetrates into the structure of the fastener tape 5*m*,5*n* and the waterproof film 6*m*,6*n* and the fastener tape 5*m*,5*n* are brought into direct contact at least partially. This allows the waterproof film 6*m*,6*n* to more firmly adhere to the fastener tape 5*m*,5*n*, facilitating the formation of the supporting portion 8. Optionally, a presser (means for pressing) is used to press the waterproof stringer 2*m*,2*n* (a laminate of the waterproof film 6*m*,6*n*, the adhesive 7, and the fastener tape 5*m*,5*n*) in the thickness direction (in other words, the lamination direction of laminate). The presser (means for pressing) may include one or more rolls such as a pressure roll urged by elastic means such as a spring. For example, the waterproof stringer 2*m*,2*n* is driven between the pressure roll and a transfer roll (with a rotational axis fixed at a predetermined position), and the waterproof stringer 2*m*,2*n* is pressed in its thickness direction. Other means for pressing may be employed.

The above-described pressing of the laminate may be followed by solidification of the adhesive 7. This is followed by cutting the waterproof film 6 by a cutting tool at a position directly over the space S1 between the opposing side-edge portions 53 of the fastener tapes 5*m*,5*n*. In cases where the adhesive 7 is thermosetting resin, the step of solidifying the adhesive 7 may preferably be performed between the above-described pressing and the above-described cutting. After the adhesive 7 penetrated to the upper portion 58 of the fastener tape 5*m*,5*n*, preferably after the adhesive 7 solidified, water repellent may be applied to the lower portion 59 of the fastener tape 5*m*,5*n*.

Just as a precaution, the above-described step of overlaying can be performed by overlaying, to the fastener tape 5*m*,5*n*, a laminate in which the waterproof film 6 and the adhesive layer have been stacked in this order on a release paper. The overlaying would be performed in such a manner that the adhesive layer and the fastener tape are brought into direct contact. In cases where the main surface of the release paper on which the waterproof film 6 is formed is a smooth surface, the top surface of the waterproof film 6 would be a smooth surface as the smooth surface of the release paper is transferred thereto. The waterproof film 6 and the adhesive layer both may be thermosetting resin, but not necessarily limited to this. Note that, the fastener chain 10 is configured from the waterproof stringers 2*m* and 2*n* in which the coil elements 4*m* and 4*n* are engaged.

FIG. 9 shows a photograph showing a cross-section of sample of a slide fastener according to the present embodiment. The fastener tape and the waterproof film are in direct contact at locations pointed by arrows in FIG. 9. Note that the arrows in the photograph are added just for illustration purpose, and the fastener tape and the waterproof film are in direct contact at other locations than the arrow-pointed locations. Further, a portion imaged in white between the fastener tape and the waterproof film in this photograph is the adhesive (especially see the right-side waterproof stringer).

Based on the above disclosure, a skilled person in the art would be able to add various modifications to the respective features and embodiments. Reference numerals in Claims are just for reference and should not be referred for a purpose of narrowly construing the scope of claims.

REFERENCE NUMERALS

1: Slide fastener
2*m*: Waterproof stringer
2*n*: Waterproof stringer
4*m*: Coil element
4*n*: Coil element
5*a*: Warp thread
5*a*1: Floating portion
5*b*: Weft thread
5*m*: Fastener tape
5*n*: Fastener tape
6: Waterproof film
6*m*: Waterproof film
6*n*: Waterproof film
7: Adhesive
9: Slider
51: Tape top surface
53: Side-edge portion
58: Upper portion
59: Lower portion
65: Film edge
91: Top wing
91*a*: Elongated partition
92: Bottom wing
93: Coupling pillar
94: Flange
95: Flange
96: Tape passage

The invention claimed is:

1. A slide fastener comprising:

a first waterproof stringer comprising a woven and/or knitted first fastener tape, a first coil element secured to a first side-edge portion of the first fastener tape, and a first waterproof film overlaid via a first adhesive on a tape top surface of the first fastener tape;

a second waterproof stringer comprising a woven and/or knitted second fastener tape, a second coil element secured to a second side-edge portion of the second fastener tape, and a second waterproof film overlaid via a second adhesive on a tape top surface of the second fastener tape, the second side-edge portion opposing to the first side-edge portion; and a slider that moves forward to engage the first and second coil elements and moves rearward to disengage the first and second coil elements, wherein the first adhesive penetrates into a structure of the first fastener tape such that the first waterproof film and the first fastener tape are in direct contact at least partially, wherein the second adhesive penetrates into a structure of the second fastener tape such that the second waterproof film and the second fastener tape are in direct contact at least partially, and wherein the first fastener tape is a woven web woven from a multiplicity of first warp threads and at least one first weft thread, the multiplicity of first warp threads includes one or more first warp threads including one or more first floating portions, a respective first floating portion being in direct contact with the first waterproof film.

2. The slide fastener of claim 1, wherein the first and second waterproof films are transparent to visible light.

3. The slide fastener of claim 1, wherein the tape top surface of the first fastener tape and a bottom surface of the first waterproof film are coplanar, and/or the tape top surface of the second fastener tape and a bottom surface of the second waterproof film are coplanar.

4. The slide fastener of claim 1, wherein a penetration depth of the first adhesive in the structure of the first fastener tape is equal to or greater than ⅓ or ½ a thickness of the first fastener tape, and/or a penetration depth of the second adhesive in the structure of the second fastener tape is equal to or greater than ⅓ or ½ a thickness of the second fastener tape.

5. The slide fastener of claim 4, wherein the penetration depth of the first adhesive is less than ⅔ the thickness of the first fastener tape, and/or the penetration depth of the second adhesive is less than ⅔ the thickness of the second fastener tape.

6. The slide fastener of claim 1, wherein the second fastener tape is a woven web woven from a multiplicity of second warp threads and at least one second weft thread, the multiplicity of second warp threads includes one or more second warp threads including one or more second floating portions, a respective second floating portion being in direct contact with the second waterproof film.

7. The slide fastener of claim 1, wherein the multiplicity of first warp threads includes two or more first warp threads including two or more first floating portions, a respective first floating portion being in direct contact with the first waterproof film.

8. The slide fastener of claim 7, wherein the second fastener tape is a woven web woven from a multiplicity of second warp threads and at least one second weft thread, the multiplicity of second warp threads includes two or more second warp threads including two or more second floating portions, a respective second floating portion being in direct contact with the second waterproof film.

9. The slide fastener of claim 1, wherein the every first warp thread of the multiplicity of first warp threads includes two or more first floating portions each in direct contact with the first waterproof film.

10. The slide fastener of claim 9, wherein the second fastener tape is a woven web woven from a multiplicity of second warp threads and at least one second weft thread, every second warp thread of the multiplicity of second warp threads includes two or more second floating portions each in direct contact with the second waterproof film.

11. A slide fastener, comprising:

a first waterproof stringer comprising a woven and/or knitted first fastener tape, a first coil element secured to a first side-edge portion of the first fastener tape, and a first waterproof film overlaid via a first adhesive on a tape top surface of the first fastener tape;

a second waterproof stringer comprising a woven and/or knitted second fastener tape, a second coil element secured to a second side-edge portion of the second fastener tape, and a second waterproof film overlaid via a second adhesive on a tape top surface of the second fastener tape, the second side-edge portion opposing to the first side-edge portion; and a slider that moves forward to engage the first and second coil elements and moves rearward to disengage the first and second coil elements, wherein the first adhesive penetrates into a structure of the first fastener tape such that the first waterproof film and the first fastener tape are in direct contact at least partially, and the second adhesive penetrates into a structure of the second fastener tape such that the second waterproof film and the second fastener tape are in direct contact at least partially, wherein the slider includes a top wing, a bottom wing, a coupling pillar that interconnects the top wing and the bottom wing, and left and right flanges arranged at least on left and right side-edge portions of the bottom wing, a tape passage defined between the flange and the top wing or between the flange and another flange arranged on the top wing, and wherein $1.82 \geq (W1/W2) \geq 1.4$ is satisfied where W1 indicates a width or a minimum width of the tape passage in up-down direction, and W2 indicates a thickness or a maximum thickness of a portion of the waterproof stringer which is inserted into the tape passage.

12. A slide fastener, comprising:

a first waterproof stringer comprising a woven and/or knitted first fastener tape, a first coil element secured to a first side-edge portion of the first fastener tape, and a first waterproof film overlaid via a first adhesive on a tape top surface of the first fastener tape;

a second waterproof stringer comprising a woven and/or knitted second fastener tape, a second coil element secured to a second side-edge portion of the second fastener tape, and a second waterproof film overlaid via a second adhesive on a tape top surface of the second fastener tape, the second side-edge portion opposing to the first side-edge portion; and a slider that moves forward to engage the first and second coil elements and moves rearward to disengage the first and second coil elements, wherein the first adhesive penetrates into a structure of the first fastener tape such that the first waterproof film and the first fastener tape are in direct contact at least partially, and the second adhesive penetrates into a structure of the second fastener tape such that the second waterproof film and the second fastener tape are in direct contact at least partially, wherein the slider includes a top wing, a bottom wing, a coupling pillar that interconnects the top wing and the bottom wing, and an elongated partition arranged on the top wing and extending rearward from the coupling pillar, and wherein the first waterproof film has a first film edge that is in contact with the elongated partition inside the slider and/or the second waterproof film has a second film edge that is in contact with the elongated partition inside the slider.

13. The slide fastener of claim 1, wherein the first fastener tape includes an upper portion to which the first adhesive penetrates and a lower portion to which a water repellent adheres and/or the second fastener tape includes an upper portion to which the second adhesive penetrates and a lower portion to which a water repellent adheres.

14. The slide fastener of claim 13, wherein the upper portion of the first fastener tape does not include a water repellent and/or the upper portion of the second fastener tape does not include a water repellent.

15. A method of producing a waterproof chain, the method comprising:

overlaying a common waterproof film via an adhesive onto tape top surfaces of both fastener tapes of a pair of fastener tapes of a fastener chain, the fastener chain including a pair of fastener stringers including the pair of fastener tapes which are woven and/or knitted and a pair of coil elements respectively secured to opposing side-edge portions of the pair of fastener tapes;

pressing a laminate of the fastener tape, the adhesive and the fastener tape such that the adhesive penetrates into a structure of the fastener tape to allow the waterproof film and the fastener tape to be in direct contact at least partially;

solidifying the adhesive; and cutting the waterproof film by a cutting tool at a position directly over a space between the opposing side-edge portions of the pair of fastener tapes.

16. The method of producing a waterproof chain of claim 15, wherein the adhesive is a thermosetting resin, and said solidifying the adhesive is performed between said pressing the laminate and said cutting the waterproof film.

17. The method of producing a waterproof chain of claim 15, wherein the waterproof film is transparent to visible light.

18. The method of producing a waterproof chain of claim 15, the method further comprising:

applying water repellent at least to a lower portion of the fastener tape after the adhesive penetrates into an upper portion of the fastener tape.

* * * * *